US009733590B2

(12) United States Patent
Kuramoto et al.

(10) Patent No.: US 9,733,590 B2
(45) Date of Patent: Aug. 15, 2017

(54) DEVELOPING DEVICE AND IMAGE FORMING APPARATUS INCLUDING THE SAME

(71) Applicant: FUJI XEROX CO., LTD., Tokyo (JP)

(72) Inventors: Shinichi Kuramoto, Kanagawa (JP); Shigemi Murata, Kanagawa (JP); Yoshitaka Nakajima, Kanagawa (JP); Ryota Tomishi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 14/858,439

(22) Filed: Sep. 18, 2015

(65) Prior Publication Data

US 2016/0282754 A1 Sep. 29, 2016

(30) Foreign Application Priority Data

Mar. 24, 2015 (JP) ..... 2015-060400

(51) Int. Cl.
*G03G 15/08* (2006.01)
*G03G 15/09* (2006.01)

(52) U.S. Cl.
CPC ..... *G03G 15/0812* (2013.01); *G03G 15/0815* (2013.01); *G03G 15/09* (2013.01); *G03G 2215/0132* (2013.01)

(58) Field of Classification Search
CPC ..... G03G 15/0881; G03G 15/0898; G03G 15/0815; G03G 15/0817
USPC ..... 15/245, 245.1, 256.51, 250.48
See application file for complete search history.

(56) References Cited

U.S. PATENT DOCUMENTS 4,165,965 A * 8/1979 Bernardelli ..... G03G 15/2025 101/425
4,561,381 A * 12/1985 Kaneko ..... G03G 15/0815 399/270
5,311,264 A 5/1994 Kinoshita
6,588,048 B2 * 7/2003 Ohyama ..... B60S 1/38 15/250.04

(Continued)

FOREIGN PATENT DOCUMENTS

JP 5-273848 A 10/1993
JP 10-3220 A 1/1998

(Continued)

*Primary Examiner* — David M Gray
*Assistant Examiner* — Sevan A Aydin
(74) *Attorney, Agent, or Firm* — Sughrue Mion, PLLC

(57) ABSTRACT

A developing device includes a developing housing that contains developer; a developer carrier that transports the developer; a layer-thickness regulating member that is provided for an upstream gap between the developer carrier and the developing housing and that regulates a layer thickness of the developer; and a sealing member that is provided for a downstream gap between the developer carrier and the developing housing. The sealing member is fixed to the developing housing at one side and is in contact with the developer on the developer carrier at the other side. The sealing member has cuts extending from a free end of the sealing member by approximately 60% or more of a dimension of the sealing member from the free end to a fixed end in the width direction, and is at an angle of approximately 30° or less with respect to a reference line.

17 Claims, 11 Drawing Sheets

(56) References Cited

U.S. PATENT DOCUMENTS

| | | | | |
|---|---|---|---|---|
| 2009/0110430 | A1* | 4/2009 | Kubota | G03G 15/0898 399/103 |
| 2010/0092205 | A1* | 4/2010 | Nishi | G03G 15/0818 399/103 |
| 2012/0292857 | A1* | 11/2012 | Brown | G03G 15/0817 277/345 |

FOREIGN PATENT DOCUMENTS

| | | | |
|---|---|---|---|
| JP | 2005-208250 | A | 8/2005 |
| JP | 5580526 | B2 | 8/2014 |

* cited by examiner

DEVELOPING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2015-060400 filed Mar. 24, 2015.

BACKGROUND

Technical Field

The present invention relates to a developing device and an image forming apparatus including the developing device.

SUMMARY

According to an aspect of the invention, there is provided a developing device including a developing housing that contains developer and has an opening that faces an image carrier capable of carrying an electrostatic latent image; a developer carrier that faces the opening in the developing housing, the developer carrier carrying and transporting the developer while rotating in such a manner that the developer carrier faces the image carrier; a layer-thickness regulating member that is provided for an upstream gap, which is one of gaps formed between the developer carrier and the developing housing and which is located upstream of the opening in a rotational direction in which the developer carrier rotates, the layer-thickness regulating member regulating a layer thickness of the developer on the developer carrier; and a sealing member that is provided for a downstream gap, which is another one of the gaps formed between the developer carrier and the developing housing and which is located downstream of the opening in the rotational direction of the developer carrier, the sealing member being formed of an elongated flexible plate that extends in a rotational axis direction of the developer carrier, being fixed to the developing housing at an upstream side in a width direction, which is a direction along the rotational direction of the developer carrier, and being in contact with the developer on the developer carrier at a downstream side in the width direction, thereby sealing the downstream gap. The sealing member has plural cuts arranged in the rotational axis direction of the developer carrier, the cuts extending from a free end of the sealing member in the width direction by a length that is approximately 60% or more of a dimension of the sealing member from the free end to a fixed end in the width direction, and being at an angle of approximately 30° or less with respect to a reference line that extends in the rotational direction of the developer carrier.

BRIEF DESCRIPTION OF THE DRAWINGS

Exemplary embodiments of the present invention will be described in detail based on the following figures, wherein:

FIGS. 4A to 4C illustrate a sealing member, wherein FIG. 4A is a perspective view illustrating the state in which a developing roller is removed, FIG. 4B illustrates the positional relationship between the sealing member and an end sealing member, and FIG. 4C illustrates the overall structure of the sealing member;

FIGS. 5A and 5B illustrate the function of cuts in the sealing member, wherein FIG. 5A illustrates the sealing member of an example in which the cuts are formed and FIG. 5B illustrates a sealing member of a comparative example in which no cuts are formed;

DETAILED DESCRIPTION

Outline of Exemplary Embodiment

Figure 1A:
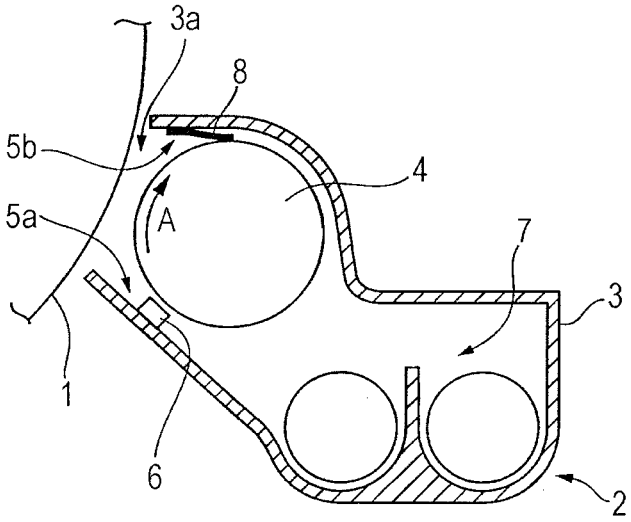
FIG. 1A illustrates a developing device according to an exemplary embodiment of the present invention.
Figure 1B:
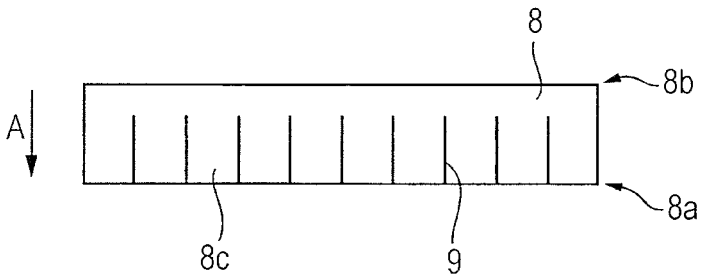
FIG. 1B illustrates a sealing member according to the exemplary embodiment of the present invention.

FIG. 1A illustrates a developing device 4 according to an exemplary embodiment of the present invention, and FIG. 1B illustrates a sealing member 8, which will be described below.

Referring to FIG. 1A, the developing device 2 includes a developing housing 3, a developer carrier 4, a layer-thickness regulating member 6, and a sealing member 8. The developing housing 3 contains developer and has an opening 3*a* that faces an image carrier 1 capable of carrying an electrostatic latent image. The developer carrier 4 faces the opening 3*a* in the developing housing 3, and carries and transports the developer while rotating in such a manner that the developer carrier 4 faces the image carrier 1. The layer-thickness regulating member 6 is provided for an upstream gap 5*a*, which is one of gaps formed between the developer carrier 4 and the developing housing 3 and which is located upstream of the opening 3*a* in a rotational direction in which the developer carrier 4 rotates, and regulates a layer thickness of the developer on the developer carrier 4. The sealing member 8 is provided for a downstream gap 5*b*, which is another one of the gaps formed between the developer carrier 4 and the developing housing 3 and which is located downstream of the opening 3*a* in the rotational direction of the developer carrier 4, and is formed of an elongated flexible plate that extends in a rotational axis direction of the developer carrier 4. The sealing member 8 is fixed to the developing housing 3 at an upstream side in a width direction, which is a direction along the rotational direction of the developer carrier 4, and is in contact with the developer on the developer carrier 4 at a downstream side in the width direction, thereby sealing the downstream gap 5*b*. The sealing member 8 has plural cuts 9 arranged in the rotational axis direction of the developer carrier 4, the cuts 9 extending from a free end 8*a* of the sealing member 8 in the width direction by a length that is 60% or more or approximately 60% or more of the dimension of the sealing member 8 from the free end 8*a* to a fixed end 8*b* in the width direction, and being at an angle of 30° or less or approximately 30° or less with respect to a reference line that extends in the rotational direction of the developer carrier 4

(direction of arrow A in FIGS. 1A and 1B). In FIG. 1A, the developer is supplied to the developer carrier 4 by a developer supplying member 7 in the developing housing 3.

In the above-described technical structure, the developer may be either one-component developer or two-component developer. There is no particular limitation regarding the shape, material, etc., of the layer-thickness regulating member 6 as long as the layer-thickness regulating member 6 is capable of regulating the layer thickness of the developer on the developer carrier 4 before the developer reaches a developing region in which the image carrier 1 and the developer carrier 4 oppose each other. Also, there is no particular limitation regarding the developer supplying member 7 as long as the developer supplying member 7 is capable of supplying the developer to the developer carrier 4. In FIG. 1A, the developer supplying member 7 includes two stirring-and-transporting members for, for example, two-component developer. However, one-component developer may instead be used.

There is no particular limitation regarding the sealing member 8 as long as the sealing member 8 is a flexible plate, and a resin film sheet made of polyester, polycarbonate, or the like may be used. In the case where a film sheet is used, if the cuts 9 are not formed, the sealing member 8 absorbs moisture and swells, in particular, in high-humidity environments, and is deformed into a wavy shape at the free end 8*a* thereof. When the sealing member 8 is deformed in this manner, a large gap is formed between the sealing member 8 and the developer carrier 4 and there is a risk that the developer will leak through the gap. In this example, the cuts 9 are formed in the sealing member 8 to suppress the deformation of the sealing member 8.

The developing device 2 according to the present exemplary embodiment may be structured as follows.

That is, the cuts 9 may be formed such that the pitch thereof is 30 mm or less or approximately 30 mm or less over a region in which the developer adheres to the developer carrier 4 in the rotational axis direction of the developer carrier 4. When the pitch of the cuts 9 is too large, cut sections 8*c* formed between the adjacent cuts 9 are easily deformed in a manner similar to that in the case where the cuts 9 are not formed. To suppress such a deformation, the pitch of the cuts 9 may be 30 mm or less or approximately 30 mm or less.

Also, the cuts 9 may be formed such that the pitch thereof is 5 mm or more or approximately 5 mm or more. When the pitch of the cuts 9 is too small, the strength of the cut sections 8*c* formed between the adjacent cuts 9 is insufficient. In such a case, the sealing member 8 cannot be reliably pressed against the developer carrier 4. To prevent this, the pitch may be 5 mm or more or approximately 5 mm or more.

The developing device 2 may be included in an image forming apparatus. In such a case, the image forming apparatus may include the image carrier 1 capable of carrying an electrostatic latent image and the above-described developing device 2 that develops the electrostatic latent image on the image carrier 1 with the developer.

The present invention will be described in more detail based on an exemplary embodiment of the present invention illustrated in the accompanying drawings.

Exemplary Embodiment

Overall Structure of Image Forming Apparatus

Figure 2:
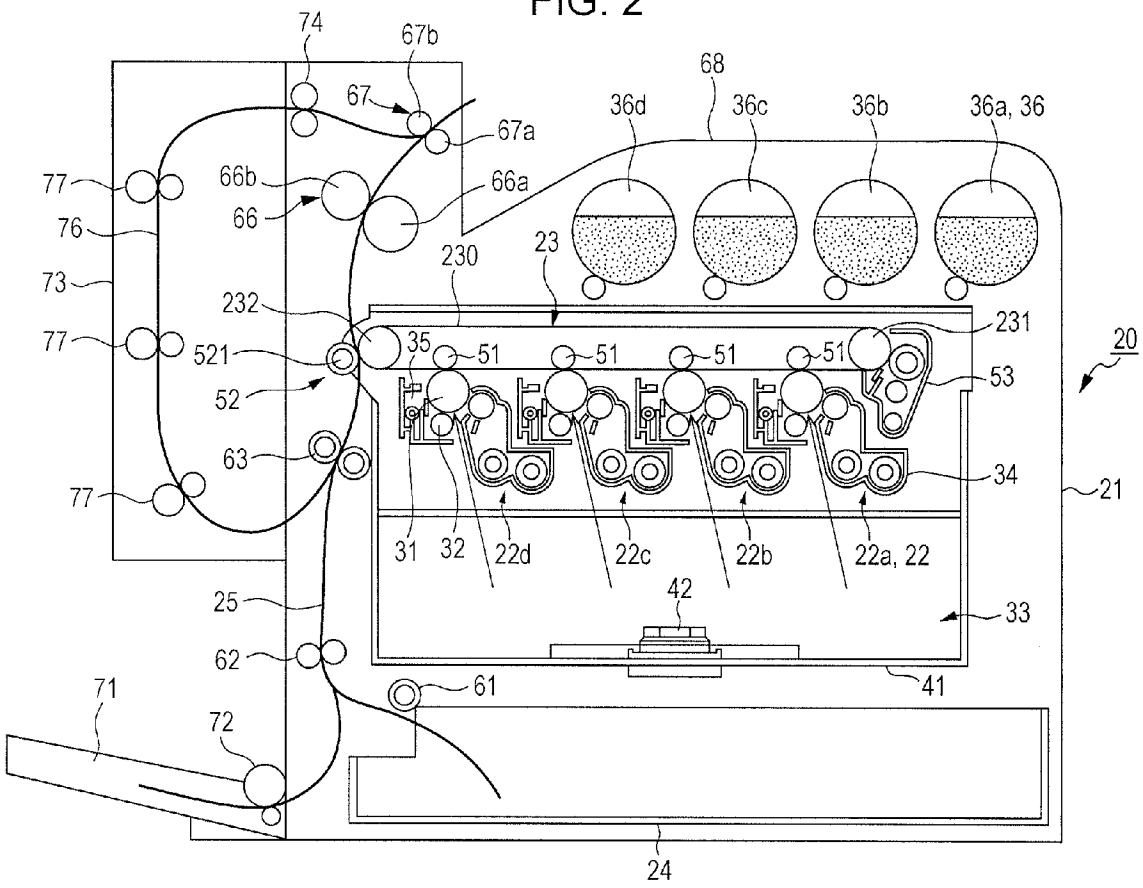
FIG. 2 illustrates the overall structure of an image forming apparatus according to an exemplary embodiment.

FIG. 2 illustrates an image forming apparatus 20 according to the exemplary embodiment.

Referring to FIG. 2, the image forming apparatus 20 includes four image forming units 22 (22*a* to 22*d*) which correspond to the respective colors (black, yellow, magenta, and cyan in this example), and which are arranged in a horizontal direction in an apparatus housing 21. A transfer module 23 is disposed above the image forming units 22. The transfer module 23 includes an intermediate transfer belt 230 that rotates in the direction in which the image forming units 22 are arranged. A recording-medium feeding device 24, which contains recording media such as sheets of paper, is disposed in a lower section of the apparatus housing 21. A recording-medium transport path 25 is arranged so as to extend substantially vertically upward from the recording-medium feeding device 24.

In the present exemplary embodiment, the image forming units 22 (22*a* to 22*d*) form black, yellow, magenta, and cyan images, and are arranged in that order from the upstream side in the direction in which the intermediate transfer belt 230 rotates (the order in which the image forming units are arranged is not necessarily limited to this). Each image forming unit 22 includes a photoconductor 31; a charging device (charging roller in this example) 32 that charges the photoconductor 31 in advance; an exposure device 33 (exposure device shared by the image forming units 22 in this example) that forms an electrostatic latent image on the photoconductor 31 charged by the charging device 32; a developing device 34 that develops the electrostatic latent image formed on the photoconductor 31 with toner of the corresponding color (the toner has, for example, a negative polarity in this example); and a cleaning device 35 that removes substances that remain on the photoconductor 31.

The exposure device 33 includes an exposure housing 41 that contains, for example, four semiconductor lasers (not shown), a single polygon mirror 42, imaging lenses (not shown), and mirrors (not shown) corresponding to the respective photoconductors. Light beams emitted from the semiconductor lasers for the respective colors are reflected by the polygon mirror 42, so that optical images are guided to exposure points on the corresponding photoconductors 31 through the imaging lenses and mirrors. The toners of the respective colors are supplied to the developing devices 34 from toner cartridges 36 (36*a* to 36*d*).

In the present exemplary embodiment, the transfer module 23 is structured such that the intermediate transfer belt 230 is looped around, for example, a pair of rollers 231 and 232, one of which is a driving roller. First transfer devices (first transfer rollers in this example) 51 are arranged on the back side of the intermediate transfer belt 230 so as to correspond to the photoconductors 31 of the image forming units 22. A voltage having a polarity opposite to the charging polarity of the toner is applied to each of the first transfer devices 51, so that the toner images on the photoconductors 31 are electrostatically transferred onto the intermediate transfer belt 230.

A second transfer device 52 is disposed so as to face a portion of the intermediate transfer belt 230 that corresponds to the roller 232 located downstream of the most downstream image forming unit 22*d*. The second transfer device 52 transfers the images formed on the intermediate transfer belt 230 by the first transfer process onto a recording medium by a second transfer process (simultaneous transfer process).

In the present exemplary embodiment, the second transfer device 52 includes a second transfer roller 521 that is pressed against a surface of the intermediate transfer belt 230 on which the toner images are formed, and a backup roller (the roller 232 is used as the backup roller in this example) that is arranged on the back side of the intermediate transfer belt 230 and serves as a counter electrode for the second transfer roller 521. The second transfer roller 521, for example, is grounded, and a bias having the same polarity as the charging polarity of the toner is applied to the backup roller (the roller 232). A belt cleaning device 53 is disposed on the intermediate transfer belt 230 at a location upstream of the most upstream image forming unit 22*a*. The belt cleaning device 53 removes toner that remains on the intermediate transfer belt 230.

The recording-medium feeding device 24 includes a feed roller 61 that feeds the recording media. Transport rollers 62 that transport each recording medium are arranged immediately downstream of the feed roller 61. Positioning rollers 63 are arranged on the recording-medium transport path 25 at a location immediately upstream of the second transfer position. The positioning rollers 63 feed the recording medium to the second transfer position at a predetermined time. A fixing device 66 is arranged on the recording-medium transport path 25 at a location downstream of the second transfer position. As illustrated in FIG. 2, the fixing device 66 includes a heating fixing roller 66*a* containing a heater (not shown) and a pressing fixing roller 66*b* that is pressed against the heating fixing roller 66*a* and rotated when the heating fixing roller 66*a* is rotated. A recording-medium output device 67 is disposed downstream of the fixing device 66. The recording-medium output device 67 includes a pair of output rollers 67*a* and 67*b* that output the recording medium from the apparatus housing 21. The output rollers 67*a* and 67*b* nip the recording medium therebetween and transport the recording medium so that the recording medium is placed on a recording-medium receiver 68 provided in an upper section of the apparatus housing 21.

In the present exemplary embodiment, a manual feed device 71 is provided on a side of the apparatus housing 21. A recording medium placed on the manual feed device 71 is fed to the recording-medium transport path 25 by a feed roller 72. A double-sided recording module 73 is also provided on the apparatus housing 21. When a double-sided recording mode for forming images on both sides of the recording medium is selected, the recording-medium output device 67 is operated in the reverse direction and a recording medium on which an image is formed on one side thereof is introduced into the double-sided recording module 73 by guide rollers 74 disposed in front of an entrance of the double-sided recording module 73. Then, the recording medium is transported along a recording-medium returning path 76 by an appropriate number of transport rollers 77, so that the recording medium is transported to the positioning rollers 63 again.

Developing Device

Figure 3:
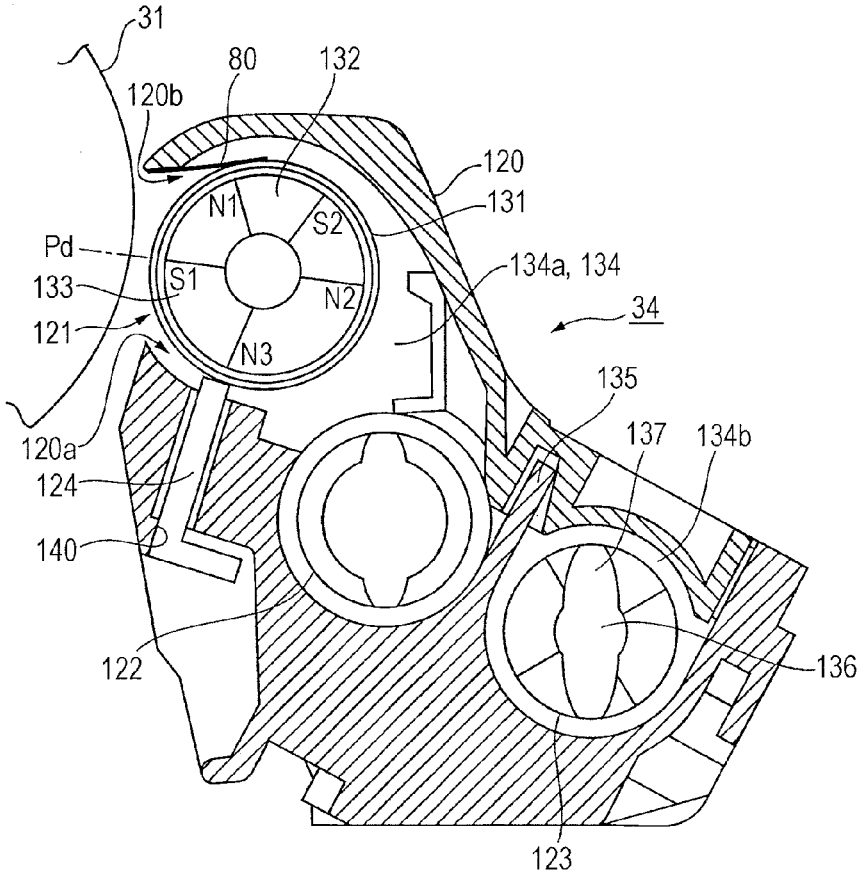
FIG. 3 illustrates the structure of a developing device.

As illustrated in FIG. 3, the developing device 34 includes a developing housing 120 that contains two-component developer containing toner and carrier and that has an opening that faces the photoconductor 31. A developing roller 121, which carries and transports the developer, is arranged so as to face the opening in the developing housing 120. A pair of stirring-and-transporting members 122 and 123, which stir and transport the developer, are disposed behind the developing roller 121 in the developing housing 120. A layer-thickness regulating member 124, which regulates the layer thickness of the developer carried by the developing roller 121, is disposed upstream of a developing position of the developing roller 121 in a rotational direction in which the developing roller 121 rotates.

In this example, tracking rollers (not shown) for position adjustment having a diameter slightly greater than that of the developing roller 121 is provided at both ends of the developing roller 121. The tracking rollers are brought into contact with the surface of the photoconductor 31 so that the gap between the developing roller 121 and the photoconductor 31 is adjusted to a predetermined gap.

Developing Roller

As illustrated in FIG. 3, the developing roller 121 includes a cylindrical developing sleeve 131 made of, for example, aluminum and a magnet roller 132 that is fixed to the developing sleeve 131 and includes plural magnetic poles 133 (five magnetic poles in this example) at the periphery thereof. In this example, the magnetic poles 133 of the magnet roller 132 include a developing magnetic pole (S1) that is disposed in a developing region Pd, which faces the photoconductor 31, and used to develop the electrostatic latent image on the photoconductor 31; transporting magnetic poles (N1, S2, and N2) disposed downstream of the developing region Pd in a rotational direction in which the developing sleeve 131 rotates; and attracting/layer-regulating magnetic pole (N3) that is disposed further downstream in the rotational direction of the developing sleeve 131 at a location corresponding to the location of the layer-thickness regulating member 124. The attracting/layer-regulating magnetic pole (N3) causes the developer to adhere to the surface of the developing sleeve 131, and regulates the layer thickness of the developer in the space between the developing sleeve 131 and the layer-thickness regulating member 124.

In this example, the attracting/layer-regulating magnetic pole (N3), the developing magnetic pole (S1), and the transporting magnetic poles (N1, S2, N2) are arranged such that the adjacent magnetic poles have opposite polarities. The transporting magnetic poles (N2) and the attracting/layer-regulating magnetic pole (N3), which are adjacent to each other, have the same polarity, and therefore generate a repulsive magnetic field and serve as separating magnetic poles that temporarily remove the developer carried by the developing sleeve 131. A developing voltage (not shown) is applied to the developing sleeve 131 so that a predetermined developing electric field is formed between the photoconductor 31 and the developing sleeve 131.

Stirring-and-Transporting Members

In this example, the developing housing 120 has a developer containing section 134 that is sectioned into two chambers 134*a* and 134*b* by a partition wall 135. One developer containing chamber 134*a* contains the developing roller 121 and one stirring-and-transporting member 122, and the other developer containing chamber 134*b* contains the other stirring-and-transporting member 123. The partition wall 135 has communication holes (not shown) at both ends thereof in the longitudinal direction. The pair of stirring-and-transporting members 122 and 123, which are arranged in the respective chambers of the developer containing section 134, rotate so as to circulate the developer between the two chambers of the developer containing section 134 through the communication holes. In this example, each of the stirring-and-transporting members 122 and 123 includes a rotating shaft 136 and a helical blade 137 provided at the periphery of the rotating shaft 136. One stirring-and-transporting member 122 is disposed substantially directly below the developing roller 121, and the developer that is stirred and transported by the stirring-and-transporting member 122 is supplied to the developing roller 121. Therefore, the stirring-and-transporting member 122 serves as a developer supplying member that supplies the developer to the developing roller 121.

Layer-Thickness Regulating Member

In this example, the layer-thickness regulating member 124 is provided for an upstream gap 120*a* formed between the developing roller 121 and the developing housing 120 at a location upstream of the opening, which corresponds to a region in which the developing roller 121 and the photoconductor 31 oppose each other, in a rotational direction in which the developing roller 121 rotates. The layer-thickness regulating member 124 is formed of a plate-shaped member, and is fixed to an attachment portion 140 provided on the developing housing 120 in advance. The layer-thickness regulating member 124 forms a gap for regulating the layer thickness of the developer between the developing housing 120 and the developing roller 121, thereby regulating the layer thickness of the developer on the developing roller 121.

Sealing Member

In this example, a sealing member 80 seals a downstream gap 120*b* formed between the developing roller 121 and the developing housing 120 at a location downstream of the opening in the rotational direction of the developing roller 121. The sealing member 80 is formed of an elongated flexible plate that extends in a rotational axis direction of the developing roller 121. The sealing member 80 is fixed to the developing housing 120 at an upstream side in a width direction, which is a direction along the rotational direction of the developing roller 121, and is in contact with the developer on the developing roller 121 at a downstream side in the width direction.

Figure 4A:
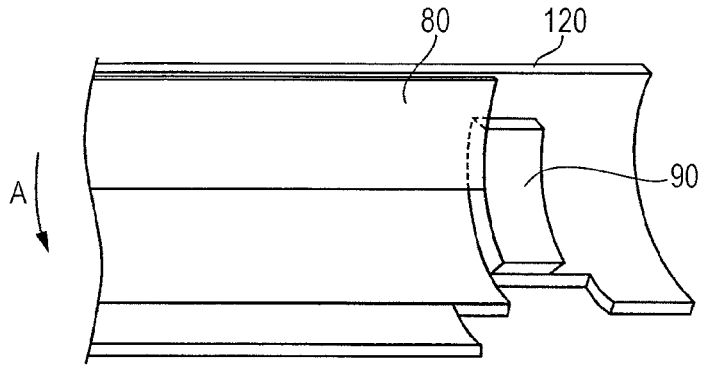
Figure 4B:
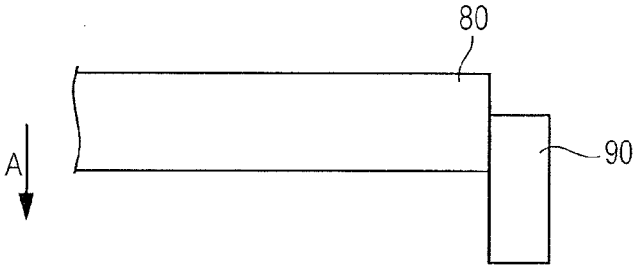
Figure 4C:
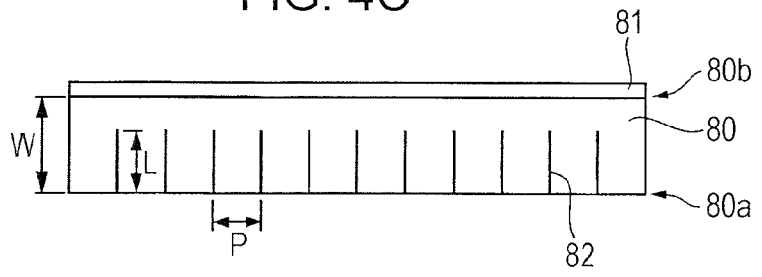

FIGS. 4A to 4C illustrate the sealing member 80. FIG. 4A is a perspective view illustrating the state in which the developing roller 121 is removed. FIG. 4B illustrates the positional relationship between the sealing member 80 and an end sealing member 90. FIG. 4C illustrates the overall structure of the sealing member 80.

Referring to FIGS. 4A and 4B, the end sealing member 90, which seals a gap between an end of the developing roller 121 and the developing housing 120, is provided on the developing housing 120 at the end of the developing roller 121, and is fixed to the developing housing 120 by a known method, such as adhesion. The developing roller 121 (not shown) is in contact with the end sealing member 90 along the direction of arrow A, which corresponds to a reference line. Although the end sealing member 90 is provided at each end of the developing roller 121, only one end sealing member 90 is illustrated in FIGS. 4A and 4B.

The sealing member 80 is disposed between the end sealing members 90 at both ends so that the ends of the sealing member 80 are both in contact with the respective end sealing members 90. In the present exemplary embodiment, the sealing member 80 is formed of, for example, an elongated polyester sheet having a thickness of 100 μm. The sealing member 80 have plural cuts 82 that extend from a free end 80*a* of the sealing member 80 in the width direction by a length that is 60% or more or approximately 60% or more of the dimension of the sealing member 80 from the free end 80*a* to a fixed end 80*b* in the width direction. The cuts 82 are arranged in the rotational axis direction of the developing roller 121. The pitch of the cuts 82 in the rotational axis direction of the developing roller 121 is 20 mm. In this example, the cuts 82 are at an angle of approximately 0° with respect to the reference line that extends in the rotational direction of the developing roller 121, which corresponds to the direction of arrow A in FIGS. 4A and 4B.

More specifically, in this example, the sealing member 80 has cuts 82 that extend from the free end 80*a* toward the fixed end 80*b* in the width direction. The length L of the cuts 82 is 60% of the overall width W, and the pitch P of the cuts 82 is 20 mm.

Operation of Developing Device

The operation of the developing device 34 will now be described.

The operation of the developing device 34 performed when the image forming apparatus carries out an image forming process will be described.

In each of the image forming units 22, when an electrostatic latent image is formed on the photoconductor 31, the developing roller 121 and the stirring-and-transporting members 122 and 123 of the developing device 34 are rotated in predetermined directions. The attracting/layer-regulating magnetic pole (N3) causes the developer to adhere to the developing roller 121 after the developer is charged. The layer thickness of the developer is regulated by the layer-thickness regulating member 124, and then the electrostatic latent image on the photoconductor 31 is developed in the developing region Pd.

After the development process, the developer passes through the sealed portion that is sealed by the sealing member 80, and returns to the inside of the developing housing 120 due to the rotation of the developing roller 121. Then, the developer is separated from the developing roller 121 by the repulsive magnetic field generated by the separating magnetic poles N2 and N3. The toner scatters when the developer is separated from the separating magnetic poles N2 and N3. The toner that has scattered floats in the developing housing 120 in the form of a cloud. When the inner pressure increases due to the toner cloud, there is a risk that the toner will leak through an opening in the developing housing 120. The increase in the inner pressure of the developing housing 120 also occurs when, for example, the size of the developing device 34 is reduced or the operational speed of the developing device 34 is increased. Also in this case, there is a risk that the developer (in particular, toner) will leak out of the developing housing 120.

In the present exemplary embodiment, gaps between the developing roller 121 and the developing housing 120 from which the developer may leak include the upstream gap 120*a*, which is located at an upstream side in the rotational direction of the developing roller 121, and the downstream gap 120*b*, which is located at a downstream side in the rotational direction of the developing roller 121.

Function of Cuts in Sealing Member

In general, the inner pressure of the developing housing 120 increases as the developing speed increases. When the developer (in particular, toner in this example) scatters and leaks out of the developing housing 120, components may be stained and reduction in image quality (fogging) may be occur. Therefore, gaps in the developing housing 120 need to be dealt with carefully. Among the gaps between the developing housing 120 and the developing roller 121, it is not necessary to consider leakage of the developer from the developing housing 120 through the upstream gap 120*a*, at which the layer-thickness regulating member 124 is provided. However, it is necessary to take the downstream gap 120*b*, at which the sealing member 80 is provided, into careful consideration.

Figure 5B:
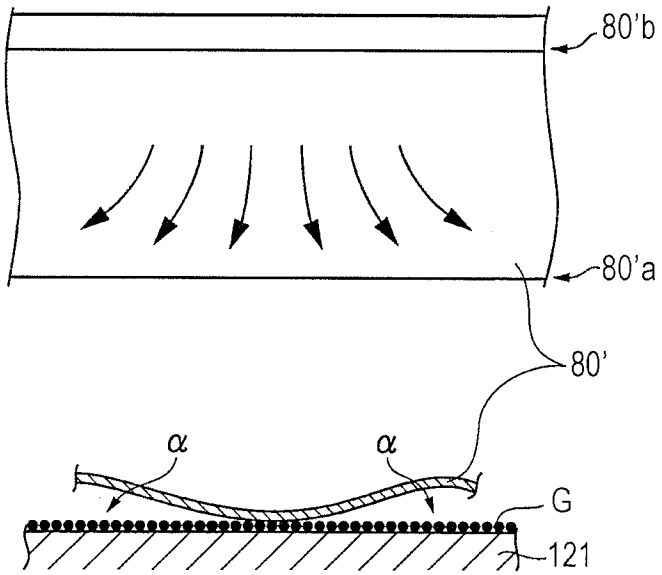
FIG. 5B RELATED ART
Figure 5A:
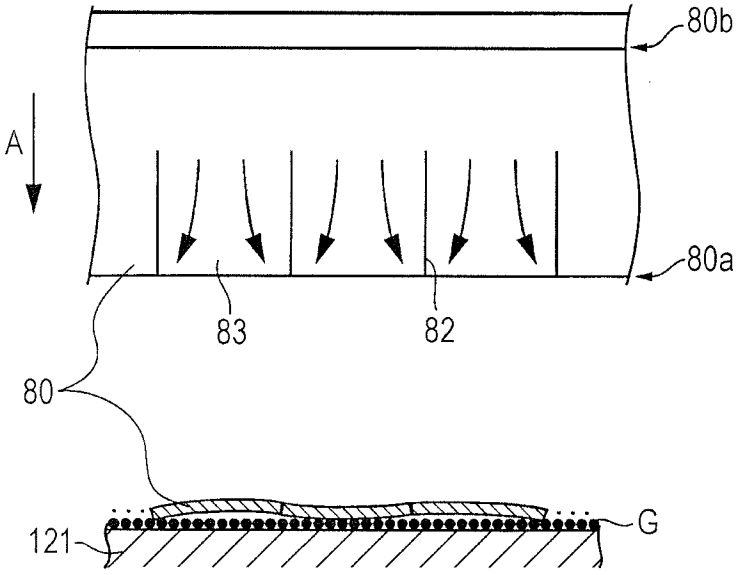

FIGS. 5A and 5B illustrate the function of the cuts 82 in the sealing member 80. FIG. 5A illustrates the sealing member 80 of this example, and FIG. 5B illustrates a sealing member 80' according to a comparative example in which no cuts are formed. The upper parts of FIGS. 5A and 5B are plan views of the sealing members 80 and 80' viewed from the front, and the lower parts of FIGS. 5A and 5B are sectional views.

The function of the cuts 82 in the sealing member 80 will now be described.

First, the structure of the comparative example illustrated in FIG. 5B will be described.

In a high-humidity environment (for example, 30° C., 85% RH), a film sheet generally swells. In particular, when the film sheet is long, the film sheet expands by a large amount in the longitudinal direction thereof. When the film sheet is not fixed at any portion thereof, the entire film sheet expands, and deformation of the sheet is not large. However, when the sheet is fixed at one end thereof in the width direction, as in the sealing member 80', the sheet expands by a large amount toward the free end thereof (in the directions shown by the arrows in FIG. 5B). In the sealing member 80', which does not have the cuts 82, since the expansion in the longitudinal direction is suppressed at the fixed end 80*b*', the sealing member 80' expands by a larger amount at the free end 80*a*'. As a result, the sealing member 80' is easily wrinkled (deformed into a wavy shape) in the longitudinal direction. When wrinkles are formed, large gaps α are formed between the sealing member 80' and the developing roller 121. Accordingly, the developer G leaks through the gaps α.

In contrast, as illustrated in FIG. 5A, since the sealing member 80 has the cuts 82 formed therein, even when the sealing member 80 swells in, for example, a high-humidity environment, the expansion is distributed among cut sections 83. Therefore, the amount of expansion of each cut section 83 is small, and formation of the wrinkles in the longitudinal direction is suppressed. Accordingly, formation of gaps between the sealing member 80 and the developing roller 121 through which the developer G leaks is also suppressed.

In the present exemplary embodiment, a polyester sheet is used as the sealing member 80. However, the sealing member 80 is not limited to this, and may instead be, for example, a polycarbonate sheet. In addition, the thickness of the sheet is not limited to 100 μm, and may instead be, for example, a thickness in the range of 50 to 125 μm.

Furthermore, although two-component developer is used as the developer in the developing device 34 according to the present exemplary embodiment, one-component developer may instead be used.

EXAMPLES

Figure 6A:
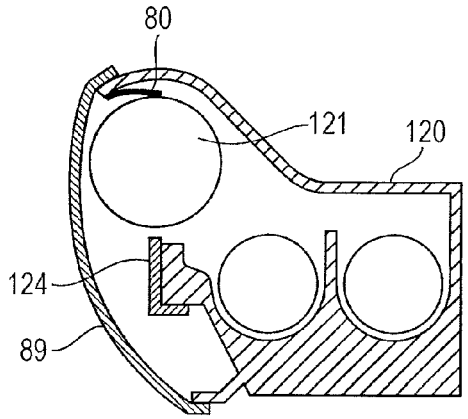
FIG. 6A illustrates an experimental device.
Figure 6B:
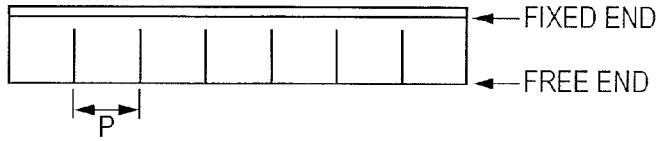
FIGS. 6B to 6D illustrate parameters of evaluation.
Figure 6C:
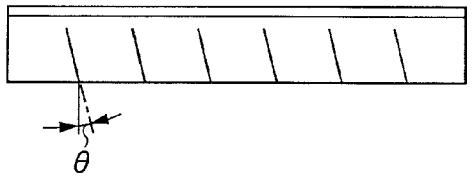
Figure 6D:
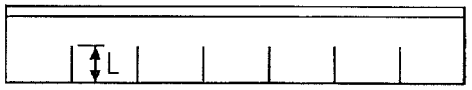

The effect of the cuts formed in the sealing member according to the exemplary embodiment is evaluated. The evaluation is performed by using an experimental device illustrated in FIG. 6A, and the amount of developer that adheres to a sheet 89 attached to the developing housing 120 is measured. The experimental device is similar to the developing device according to the exemplary embodiment except that the layer-thickness regulating member 124 is plate-shaped instead of rod-shaped. FIGS. 6B to 6D illustrate parameters of the evaluation. FIG. 6B shows the cut pitch P, FIG. 6C shows the cut angle θ (angle relative to the reference line when the reference line extends in the direction along the rotational direction of the developing roller), and FIG. 6D shows the cut length L. In the following direction, reference numerals of the components are omitted.

The experimental conditions are as follows:

(1) Sealing Member: 100-μm-thick polyester sheet whose length from the free end to the fixed end is 10 mm is used.

(2) Cut Pitch: the cut length from the free end is set to about 8 mm, and the pitch P is changed in the range of 1 to 50 mm.

(3) Cut Angle θ: the cut length from the free end (length in the direction along the rotational direction of the developing roller) is set to about 8 mm, and the angle θ is changed in the range of 5 to 50°.

(4) Cut Length L: the cuts are formed in the direction along the rotational direction of the developing roller, and the length L is changed in the range of 0 to 10 mm.

Figure 7:
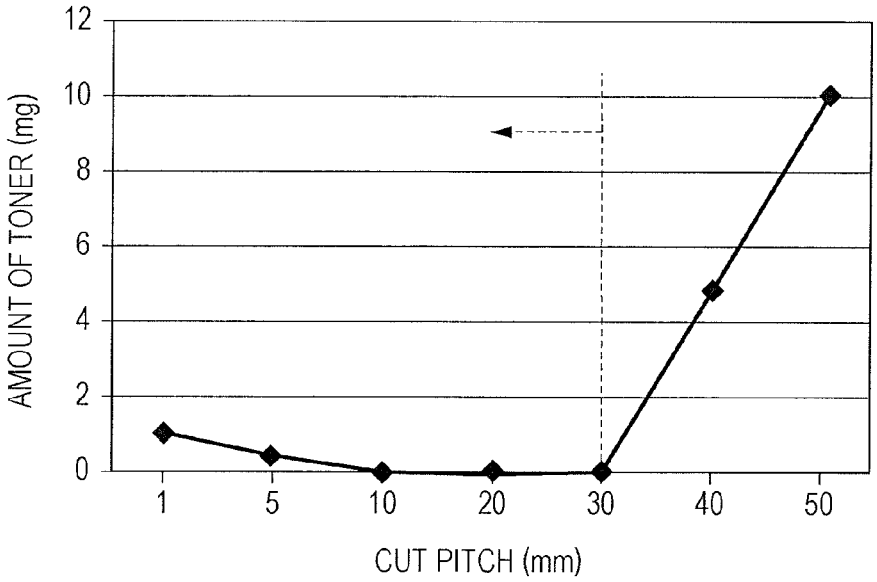
FIG. 7 is a graph showing a result for the cut pitch.
Figure 8:
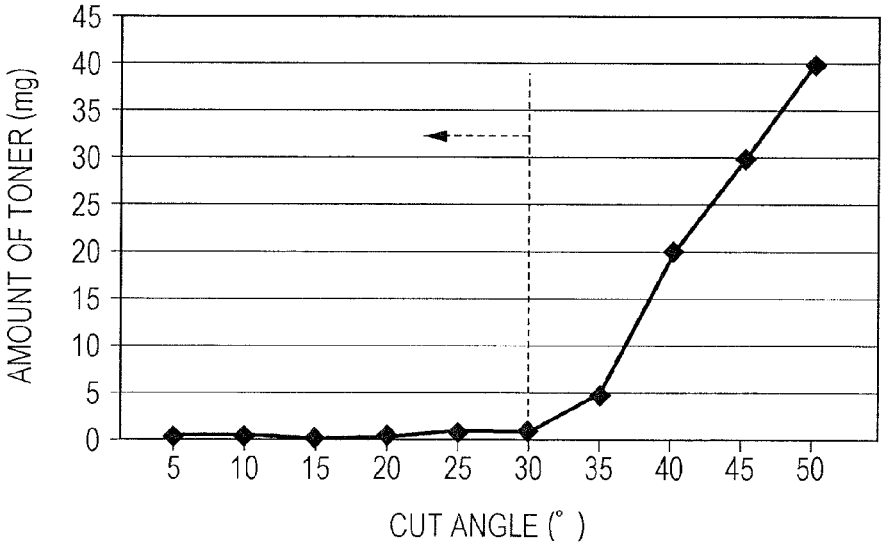
FIG. 8 is a graph showing a result for the cut angle.
Figure 9:
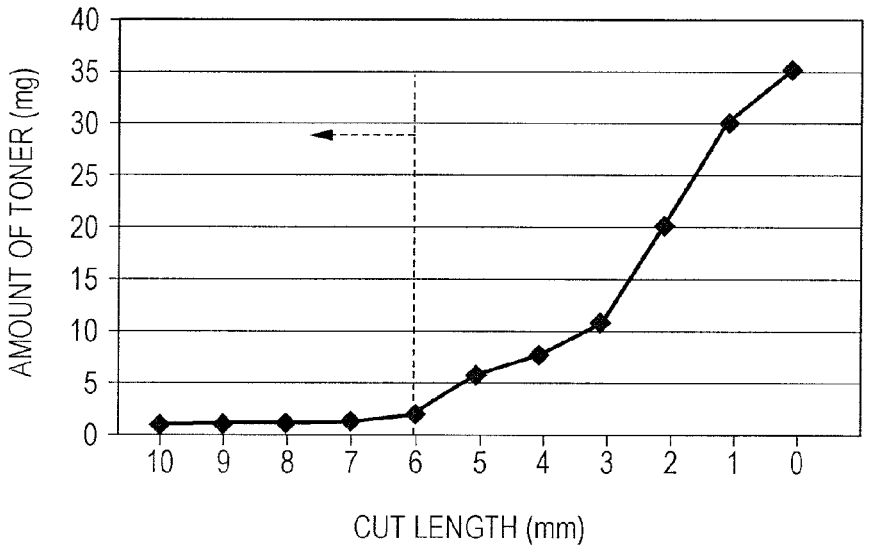
FIG. 9 is a graph showing a result for the cut length.

FIGS. 7 to 9 are graphs showing the results. More specifically, the following results are obtained.

(1) When the cut pitch P is 30 mm or less, the amount of toner that adheres to the sheet is 1 mg or less. When the cut pitch P is increased to 40 mm and 50 mm, the amount of toner that adheres to the sheet suddenly increases. When the pitch P is too small (5 mm or less), the amount of toner that adheres to the sheet slightly increases.

(2) When the cut angle θ is 30° or less, the amount of toner that adheres to the sheet is substantially 0 mg. When the angle θ is increased, the amount of toner that adheres to the sheet suddenly increases.

(3) When the cut length L is 6 mm or more, the amount of toner that adheres to the sheet is substantially 0 mg. When the length L is reduced, the amount of toner that adheres to the sheet gradually increased.

In this example, the amount of toner that adheres to the sheet is desirably approximately 0 mg. However, it is determined that the sealing member is suitable for practical use when the amount of toner that adheres to the sheet is about 1 mg. Therefore, the range of the cut pitch P is set to 30 mm or less, the range of the cut angle θ to 30° or less, and the range of the cut length L to 6 mm or more (which corresponds to 60% or more).

It is also confirmed that it is more desirable to set the cut pitch P in the range of 10 to 30 mm, the cut angle θ in the range of 30° or less, and the cut length L in the range of 6 mm (which corresponds to 60%) or more. It may seem that the pitch P may be set to 5 mm or less since the amount of toner that adheres to the sheet is 1 mg or less even when the pitch P is 5 mm or less. However, it is determined that the pitch P is desirably 10 mm or more in consideration of the process of forming the cuts and the strength of the cut sections.

Similar evaluations are performed by the inventors by using sealing members made of different materials and having different thicknesses and widths. As a result, it is confirmed that leakage of the developer may be suppressed when the cut pitch P is in the range of 10 to 30 mm, the cut angle θ in the range of 30° or less, and the cut length L in the range of 60% or more.

The cut angle θ may be set such that the cut sections extend in the same direction (inclined in the same direction in the case where the cut sections are inclined). However, when the cut angle is small, the cuts may, of course, be formed in different directions or at different angles.

With regard to the evaluation results, the above-described phenomenon of the sealing member is probably caused by the following factors.

Regarding Cut Pitch

Figures 10A, 10B, 10C:
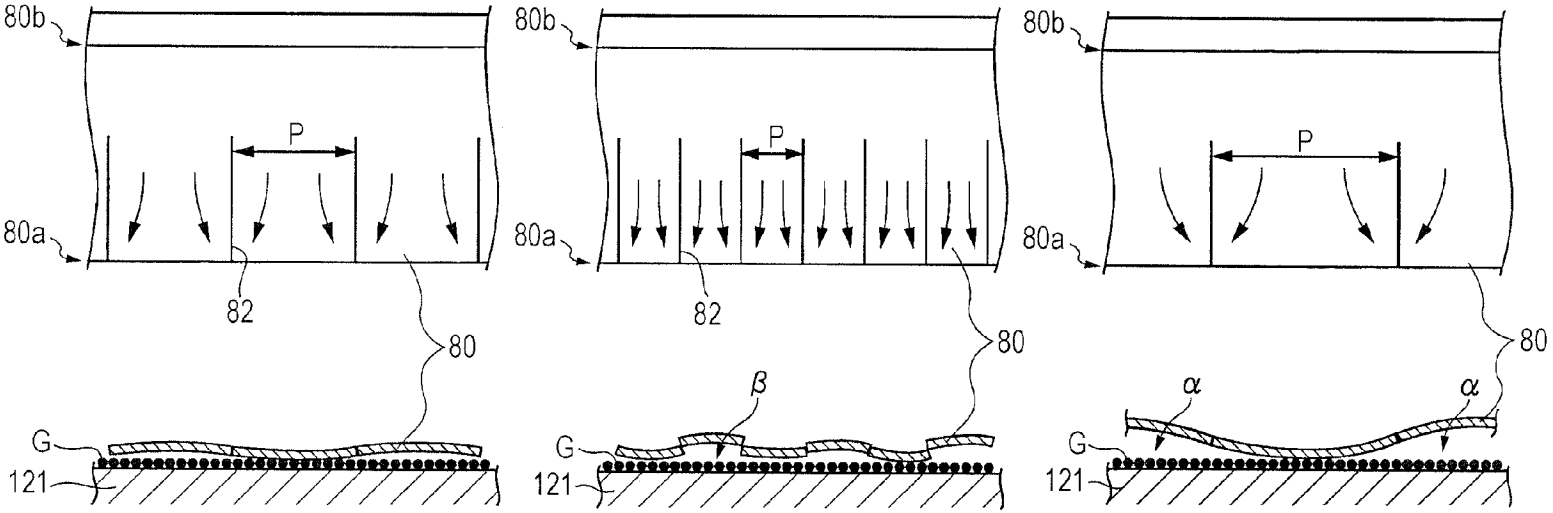
FIGS. 10A to 10C illustrate the state of the sealing member when the cut pitch is set to three standard values.

First, the cut pitch P will be discussed. FIGS. 10A to 10C illustrate the state of the sealing member obtained when the cut pitch P is set to three standard values. FIG. 10A shows an appropriate pitch P, FIG. 10B shows a small pitch P, and FIG. 10C shows an excessively large pitch P.

Referring to FIG. 10A, when the pitch P is appropriate, the expansion of the sealing member is distributed among the cut sections. Therefore, formation of wrinkles in the longitudinal direction of the sealing member (rotational axis direction of the developing roller) is suppressed. As a result, large gaps are not formed between the developing roller and the sealing member.

In contrast, as illustrated in FIG. 10B, when the pitch P is too small, although the expansion is distributed among the cut sections, the strength of each cut section is reduced. Therefore, for example, there is a risk that the adjacent cut sections overlap. When the cut sections overlap in this manner, small gaps β are formed between the developing roller and the sealing member, and there is a risk that a small amount of developer will leak through these gaps.

When the pitch P is two large, as illustrated in FIG. 10C, each cut section expands in a manner similar to that in the case where no cuts are formed. Therefore, wrinkles are easily formed in each cut section. As a result, wrinkles are formed in the longitudinal direction of the sealing member, and large gaps α are formed between the developing roller and the sealing member.

Cut Angle

The cut angle θ will be discussed with reference to FIGS. 11A and 11B. FIG. 11A illustrates the case in which the angle θ is small, and FIG. 11B illustrates the case in which the angle θ is large.

When the cuts are formed at the angle θ illustrated in FIG. 11A, the amount of expansion differs between an obtuse portion γ and an acute portion δ at the free end of each cut section. More specifically, the acute portion δ tends to expand by a larger amount. However, in FIG. 11A, the obtuse portion γ and the acute portion δ at the free end have strengths that do not differ by a large amount. Therefore, each cut section absorbs the expansion thereof, and formation of wrinkles in the longitudinal direction of the sealing member is suppressed.

Figure 11B:
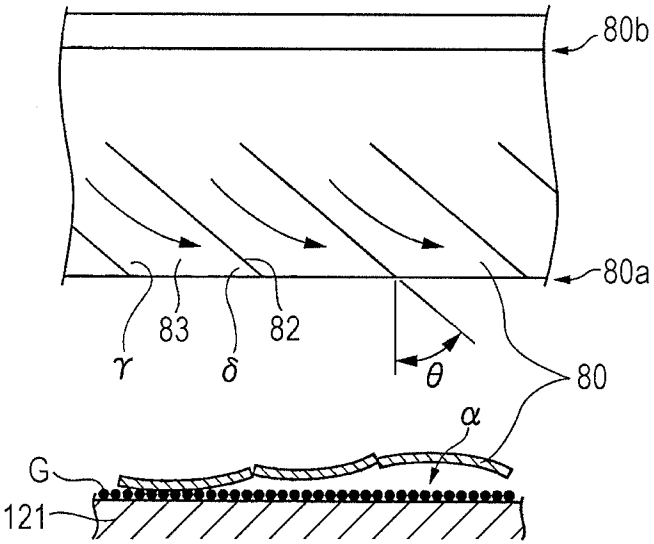
FIGS. 11A and 11B illustrate the state of the sealing member when the cut angle is set to two standard values.
Figure 11A:
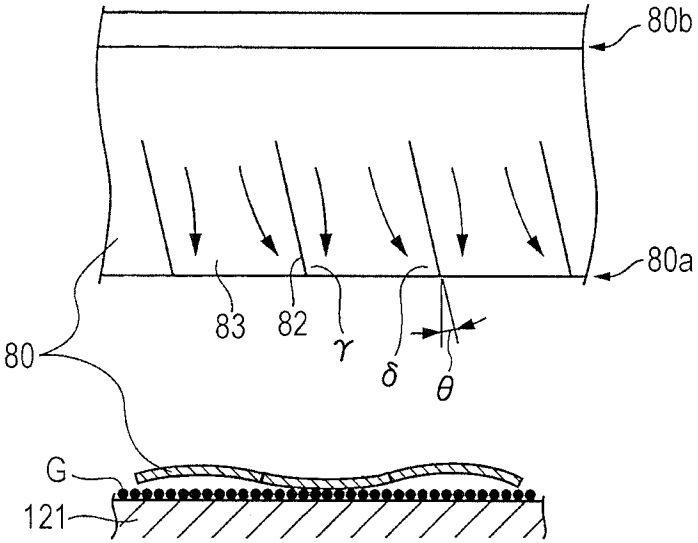

In contrast, when the cut angle θ is too large as in FIG. 11B, the obtuse portion γ and the acute portion δ at the free end of each cut section have strengths that differ by a large amount, and the acute portion δ expands by a large amount. Moreover, the strength of the acute portion δ decreases as the distance from the free end decreases, and the amount of expansion increases accordingly. Therefore, wrinkles are formed in the longitudinal direction of the sealing member, and large gaps α are formed between the developing roller and the sealing member.

Regarding Cut Length

The cut length L will be discussed with reference to FIGS. 12A and 12B. FIG. 12A illustrates the case in which the length L is sufficiently large, and FIG. 12B illustrates the case in which the length L is too small.

When the cuts have the length L illustrated in FIG. 12A, the expansion is distributed among the cut sections, and formation of wrinkles in the longitudinal direction of the sealing member is suppressed.

Figure 12B:
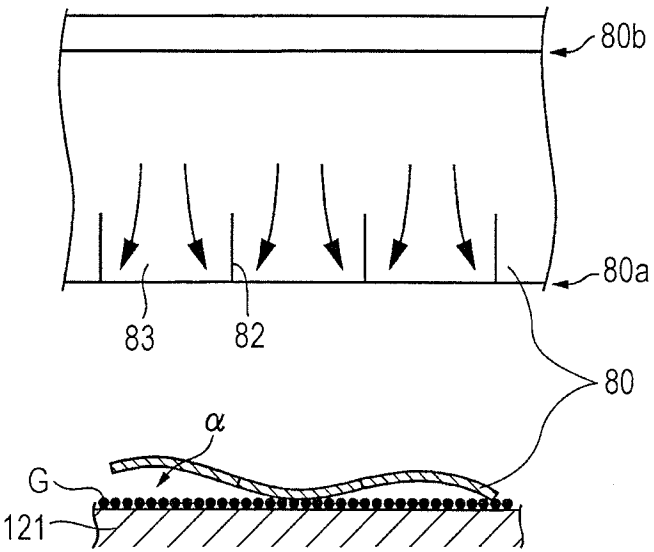
FIGS. 12A and 12B illustrate the state of the sealing member when the cut length is set to two standard values.
Figure 12A:
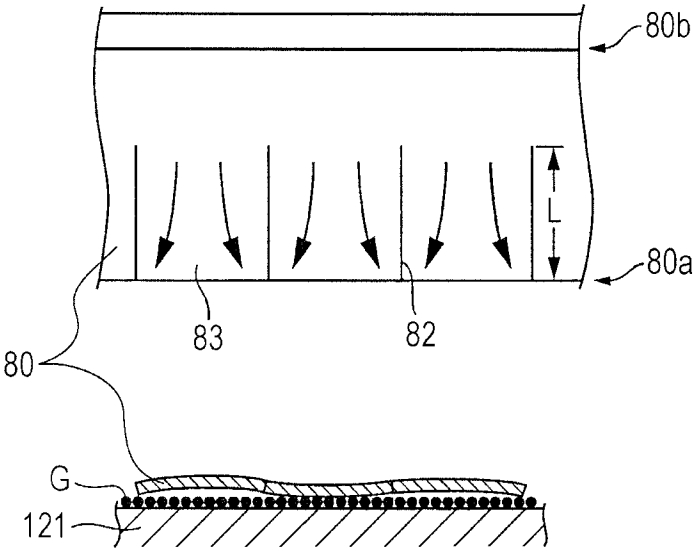

In contrast, as illustrated in FIG. 12B, when the length L is too small, the expansion is not easily distributed among the cut sections, and there is a risk that large wrinkles will be formed in an end portion in the longitudinal direction, similar to the case in which no cuts are formed. As a result, wrinkles are formed in the longitudinal direction of the sealing member, and large gaps α are formed between the developing roller and the sealing member. Therefore, leakage of the developer may occur.

Thus, the effectiveness of the sealing member according to the example is confirmed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing housing that contains developer and has an opening that faces an image carrier capable of carrying an electrostatic latent image;

a developer carrier that faces the opening in the developing housing, the developer carrier carrying and transporting the developer while rotating in such a manner that the developer carrier faces the image carrier;

a layer-thickness regulating member that is provided for an upstream gap, which is one of gaps formed between the developer carrier and the developing housing and which is located upstream of the opening in a rotational direction in which the developer carrier rotates, the layer-thickness regulating member regulating a layer thickness of the developer on the developer carrier; and a sealing member that is provided for a downstream gap, which is another one of the gaps formed between the developer carrier and the developing housing and which is located downstream of the opening in the rotational direction of the developer carrier, the sealing member being formed of an elongated flexible plate that extends in a rotational axis direction of the developer carrier, being fixed to the developing housing at an upstream side in a width direction, which is a direction along the rotational direction of the developer carrier, and being in contact with the developer on the developer carrier at a downstream side in the width direction, thereby sealing the downstream gap, wherein the sealing member has a plurality of cuts arranged in the rotational axis direction of the developer carrier, the cuts extending from a free end of the sealing member in the width direction by a length that is 60% or more of a dimension of the sealing member from the free end to a fixed end in the width direction, and being at an angle of 30° or less with respect to a reference line that extends in the rotational direction of the developer carrier, and wherein the cuts are formed such that a pitch of the cuts is 5 mm or more.

2. The developing device according to claim 1, wherein the cuts are formed such that a pitch of the cuts is 30 mm or less over a region in which the developer adheres to the developer carrier in the rotational axis direction of the developer carrier.

3. An image forming apparatus comprising:

an image carrier capable of carrying an electrostatic latent image; and the developing device according to claim 2 that develops the electrostatic latent image on the image carrier with developer.

4. An image forming apparatus comprising:

an image carrier capable of carrying an electrostatic latent image; and the developing device according to claim 1 that develops the electrostatic latent image on the image carrier with developer.

5. An image forming apparatus comprising:

an image carrier capable of carrying an electrostatic latent image; and the developing device according to claim 1 that develops the electrostatic latent image on the image carrier with developer.

6. The developing device according to claim 1, wherein a length of the sealing member does not extend from a position at the upstream gap to a position at the downstream gap.

7. The developing device according to claim 1, wherein the sealing member extends along an entire length of the developer carrier in the rotational axis direction.

8. The developing device according to claim 7, wherein the sealing member is an integral body.

9. The developing device according to claim 1, wherein the sealing member is provided at a center of the developer carrier in the rotational axis direction.

10. The developing device according to claim 1, wherein the sealing member comprises a flap seal.

11. The developing device according to claim 10, wherein the sealing member is an integral body.

12. The developing device according to claim 1, wherein a length of the sealing member from the free end to the fixed end is 10 mm.

13. The developing device according to claim 1, wherein no sealing member is provided at the upstream gap.

14. The developing device according to claim 1, wherein no sealing member that is integral with the sealing member is provided at the upstream gap.

15. The developing device according to claim 1, wherein no sealing member that is connected to the sealing member is provided at the upstream gap.

16. The developing device according to claim 1, wherein the free end of the sealing member is free to flap.

17. The developing device according to claim 1, wherein the sealing member is a flap seal.

* * * * *